United States Patent [19]

Robinson

[11] Patent Number: 4,779,797

[45] Date of Patent: Oct. 25, 1988

[54] TANKWASHER

[75] Inventor: Michael Robinson, Cheltenham, Great Britain

[73] Assignee: Breconcherry Steel Limited, Great Britain

[21] Appl. No.: 135,915

[22] Filed: Dec. 21, 1987

[51] Int. Cl.[4] ..... B05B 1/34; B05B 3/10

[52] U.S. Cl. ..... 239/222.19; 239/223; 239/467; 239/474; 239/488; 134/168 R

[58] Field of Search ..... 239/214, 222.11, 222.13, 239/222.15, 222.17, 222.19, 223, 224, 231, 233, 251, 259, 261, 467, 474, 488, 489; 134/59, 168 R

[56] References Cited

U.S. PATENT DOCUMENTS

| | | | |
|---|---|---|---|
| 2,990,011 | 6/1961 | Stratford | 239/224 |
| 3,539,109 | 11/1970 | Rosenberg | 239/222.15 |
| 3,809,317 | 5/1974 | Bender | 239/251 |
| 4,030,513 | 6/1977 | McKenzie | 239/251 |
| 4,582,255 | 4/1986 | Won | 239/261 X |
| 4,624,411 | 11/1986 | Won | 239/222.19 |

FOREIGN PATENT DOCUMENTS

| | | | |
|---|---|---|---|
| 3267 | 2/1907 | United Kingdom | 239/222.17 |

*Primary Examiner*—Andres Kashnikow
*Assistant Examiner*—Mary Beth O. Jones
*Attorney, Agent, or Firm*—Arnold S. Weintraub

[57] ABSTRACT

A tankwasher which may be mounted permanently in a tank that requires frequent cleaning comprises a tube 1 connected to a source of cleaning liquid supply, a shaft 5 non-rotatably mounted in the outlet end of the tube 1 and having an enlarged head at the end thereof which protrudes from the tube 1, a liquid guide 3 surrounding said shaft 5 internally of the tube 1 and formed with helical grooves on its external surface, and a shaped liquid distribution disc 4 rotatably mounted around the shaft 5 between the head of the shaft 5 and the neighboring end of the liquid guide 3. An R-shaped resilient clip 2 constitutes the only connection of the shaft 5 to the tube 1 and, upon its removal, the shaft 5, the liquid guide 3 and the disc 4 can all be freely removed from the tube 1 and from each other for cleaning or other purposes. The rotatable disc 4 comprises apertures 9 interconnecting its opposite sides and has a formation which, during use, produces generally fan-shaped sprays of liquid at each side of its plane of rotation. A chamber 6 formed between the head of the shaft 5 and the disc 4 is connected by an annular passage 7 to the source of liquid supply and, during use, the fluid pressure in the chamber 6 substantially counterbalances that acting upon the disc 4 thus facilitating free rotation of the disc 4 around the longitudinal axes of the tube 1 and shaft 5. The disc 4 is movable lengthwise to a limited extent along the shaft 5 between its head and the liquid guide 3.

7 Claims, 3 Drawing Sheets

TANKWASHER

Within the milk, food and drug industries there are many tanks of relatively small size containing liquid. It is important for hygienic reasons that these tanks should be cleaned out regularly and that this should be done with an assurance that the quality of the cleaning process is reliable.

It is now common practice to clean such tanks using relatively small tankwashers placed permanently or semi-permanently inside the vessels. Since these tank washers clean-in-place they are known by the name, C.I.P. Tankwashers. These C.I.P. Tankwashers are rotating devices which, when supplied with a liquid under pressure, distribute an even spray of that liquid over the internal surface of the tank. The supply of the liquid could be adjusted by a control system in such a way that a pump delivers a mixture of rinsing water, detergent solution and a sterilent as a final wash.

It is important that a tankwasher for this purpose should be simple, reliable and be able to be dismantled with ease by the operator. Since all parts of the system that clean the tank need themselves to be cleaned, it is necessary that the tankwasher itself should be taken apart at regular intervals, and that its individual parts should be washed in a detergent solution.

A tankwasher in accordance with the invention is constructed so that it can easily be dismantled by an operator without tools and having little mechanical knowledge.

The tankwasher is mounted within the tank to be cleaned, is fixed in place and is connected by an external pipe to a pump and tank system supplying the cleaning and rinsing liquids. The tankwasher can be immersed in the liquid product contained in the tank without damage and without contaminating that product. The tankwasher uses no lubricant other than the cleaning solution.

Figure 1:
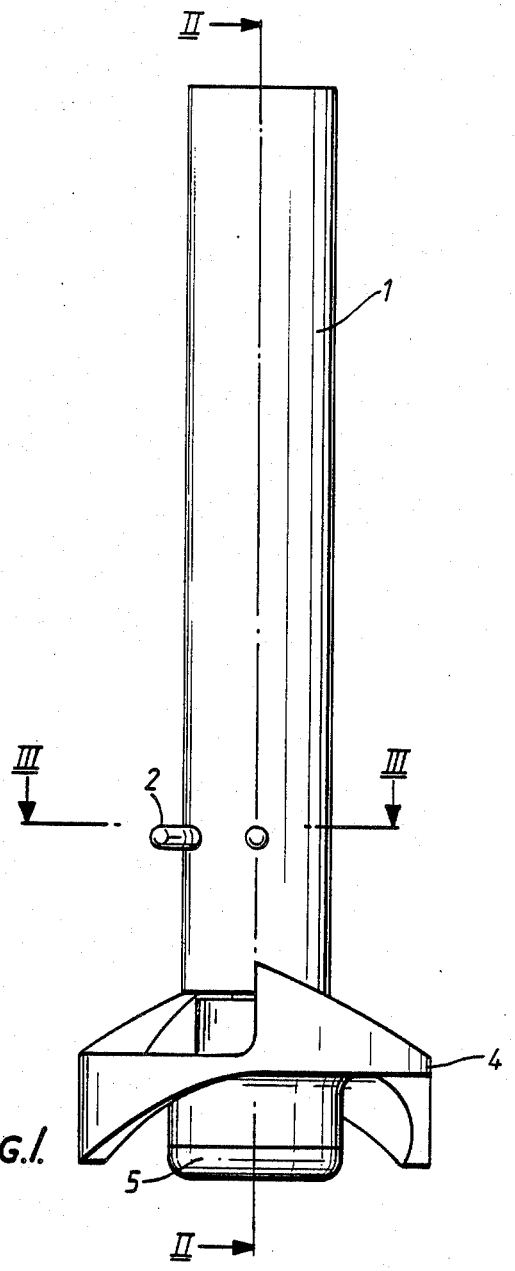
Figure 2:
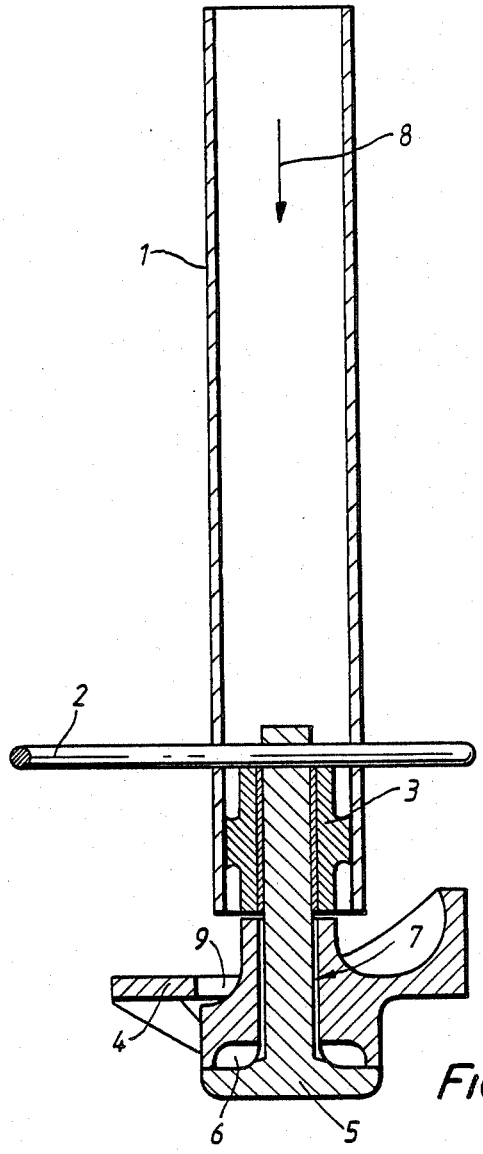
Figure 3:
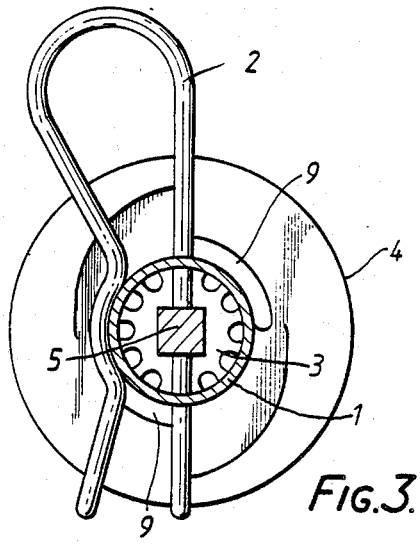
Figure 4:
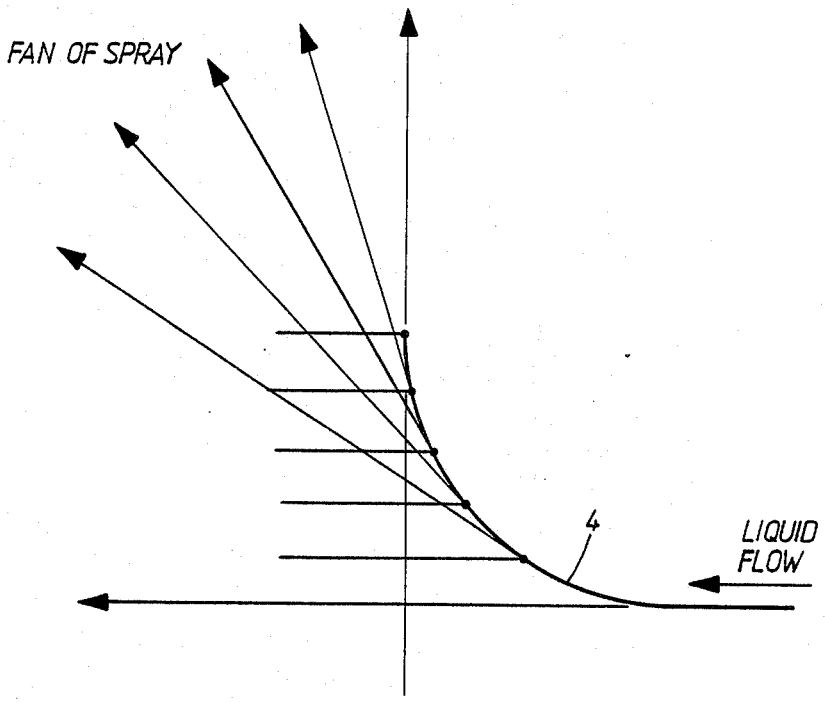

For a better understanding of the invention, and to show how the same may be carried into effect, reference will now be made, by way of example, to the accompanying drawings, in which:

FIG. 1 is an external elevation of a tankwasher in accordance with the present invention, FIG. 2 is a section taken on the line II—II in FIG. 1, FIG. 3 is a sectional plan view taken on the line III—III in FIG. 1, and FIG. 4 is a section through part of the surface of a rotary disc of the tankwasher showing how the spray distribution pattern of the latter is produced.

Referring to the drawings, the tankwasher consists of a tube 1 whose upper end is connected to external piping by butt welding. Towards its lower end, the tube 1 has a shaft 5 located in it by an 'R'-shaped resilient clip 2. The shaft 5 is further located centrally in the tube 1 by a water guide 3 which has the additional function of directing the flow of liquid in the required manner through the apparatus. This water guide 3 has a square section hole through its centre in which is engaged a similar section on the outside of the shaft 5. Freely rotatable on this shaft 5 is a disc 4 whose shape is designed to distribute the liquid over all the internal surfaces of the surrounding tank to be cleaned.

The water guide 3 has a series of helical grooves along its external surface which grooves are cut generally along the axis of the tube 1. These grooves are twisted helically with an angle which is typically 15°.

FIG. 4 shows a partial section through one of the curved surfaces of the disc 4. If water or other aqueous liquid is directed along the curved surface of this disc 4, then it will leave the edge at a tangent to that surface as shown in FIG. 4. As this curve is progressively cut away, the tangent to this edge changes and the curve is designed so that there is a progressive change of this water flow in even increments as the curve changes in angular increments about the center line. There are two of these curved surfaces above and two below the central body of this disc 4. With two such surfaces on each side of the disc 4, the reaction of the liquid moving over the surface of the disc is even and balanced and the disc will therefore rotate more uniformly.

Two of the curved surfaces on the top of the disc 4 distribute liquid in the top half of the tank to be cleaned whilst the two curved surfaces on its bottom distribute the liquid in the lower half of the tank.

The liquid which enters the tube 1 in a direction 8 leaves the water guide 3 and is directed onto the curved surfaces of the disc 4. Because of the helical grooves in the water guide, the liquid is rotating and this imparts a twist to the disc 4 to rotate it at a constant speed. Half of the liquid reaching the disc 4 is distributed to the top of the disc to clean the top half of the tank, the rest passes centrally through openings 9 in the body of the disc and is directed by the lower curved surfaces to the lower half of the tank being cleaned.

The downward flow of the liquid creates an axial thrust on the disc 4. In the lower part of this disc 4 is a small chamber that is closed by a head at the lower end of the shaft 5. The disc 4 is able to move a small amount on the shaft 5 in an axial direction. Machined into the outside of the shaft 5 are small grooves 7 which convey a small part of the total flow into this chamber 6 in the bottom of the disc 4. The chamber 6 is thereby pressurized and lifts slightly to allow some liquid to escape. The lifting of the disc 4 allows just sufficient liquid to escape so that the pressure in the chamber 6, and the resultant upward thrust, will balance the downward force due to the liquid impinging on the disc 4. The result is that the disc 4 rotates freely on this 'pad' of liquid.

Since cleaning operations can be done at high temperatures, even using steam, it is important that the materials of the tankwasher should be able to withstand such treatment.

The tankwasher will frequently be dismantled and needs to be robust enough to allow this to happen. The disc 4 may be formed from a plastics material, such as nylon or polypropylene, the remainder of the tankwasher being constructed from a suitable grade of high quality stainless steel.

To dismantle the unit, the 'R'-shaped resilient clip 2 is withdrawn and all the items fall away from the tube 1. Although the tankwasher is described and illustrated as having its tube 1 vertically disposed, this is not essential and it may be horizontally or obliquely disposed where more convenient.

What I claim is:

1. A tankwasher comprising a tube arranged for connection to a source of washing/rinsing liquid, a shaft mounted in said tube and having an enlarged head at an end thereof which protrudes from the tube, said mounting being accomplished by pin means that extends releasably through aligned openings in the shaft and the surrounding tube, a liquid guide positioned between the shaft and the surroundng tube and arranged to cause liquid passing therethrough from said source to issue therefrom in directions inclined to the longitudinal axes of the shaft and tube, a liquid distribution disc rotatably mounted around said shaft adjacent the enlarged head thereof for rotation by liquid issuing from the liquid guide, and said disc being shaped to distribute liquid therefrom in a generally fan-shaped pattern at each side of its plane of rotation, and also comprising means substantially to counterbalance the fluid pressure exerted by said source upon the disc, said counterbalance means exhibiting a chamber defined between the disc and the shaft head and a passage connecting said chamber to said source, the disc being axially displaceable along the shaft to a limited extent between the shaft head and the liquid guide.

2. A tankwasher according to claim 1, wherein said pin means constitutes the only connection of said shaft to said tube whereby, upon removing said pin means from its operative position, the shaft, the liquid guide and the disc are freely removable from the tube and from each other.

3. A tankwasher according to claim 1, wherein said disc comprises two curved surfaces at each opposite side of its plane of rotation, said curved surfaces being progressively cut away to produce, during use, the generally fan-shaped patterns of liquid distribution at each side of said plane of rotation, apertures being formed in the disc to conduct liquid to be distributed from the side thereof facing the tube to the side thereof remote from said tube.

4. A tankwasher according to claim 1, wherein the liquid guide non-rotatably surrounds said shaft, internally of said tube, and has a series of helical grooves along its external surface which grooves are wound generally around the longitudinal axis of said tube.

5. A tankwasher according to claim 4, wherein the angle of helical twist of said grooves relative to the longitudinal axis of the tube has a magnitude of substantially 15°.

6. A tankwasher according to claim 1, wherein the passage connecting said chamber to said source of liquid is formed around said shaft internally of the liquid guide and of the rotatable disc.

7. A tankwasher according to claim 2, wherein said pin means is a resilient pin of substantially R-shaped configuration.

* * * * *